US005392480A

United States Patent [19]

Ishihara et al.

[11] Patent Number: 5,392,480

[45] Date of Patent: Feb. 28, 1995

[54] WASHING METHOD BY A CONTINUOUS WASHING MACHINE

[75] Inventors: Hidetoshi Ishihara; Shoichi Hayashi; Atsushi Ueda; Hiroyuki Asaoka; Haruo Hagiwara; Toshio Hattori, all of Nagoya, Japan

[73] Assignee: Mitsubishi Jukogyo Kabushiki Kaisha, Tokyo, Japan

[21] Appl. No.: 279,691

[22] Filed: Jul. 25, 1994

Related U.S. Application Data

[63] Continuation of Ser. No. 157,331, Nov. 23, 1993, abandoned, which is a continuation of Ser. No. 869,425, Apr. 16, 1992, abandoned.

[30] Foreign Application Priority Data

| | | | |
|---|---|---|---|
| Jun. 10, 1991 | [JP] | Japan | 3-137875 |
| Jan. 13, 1992 | [JP] | Japan | 4-004054 |
| Jan. 13, 1992 | [JP] | Japan | 4-004055 |
| Apr. 19, 1992 | [JP] | Japan | 4-113682 |

[51] Int. Cl.[6] ..... D06F 31/00

[52] U.S. Cl. ..... 8/159; 68/27; 68/145

[58] Field of Search ..... 8/159; 68/27, 58, 143, 68/145, 158

[56] References Cited

U.S. PATENT DOCUMENTS

| | | | |
|---|---|---|---|
| 4,020,659 | 5/1977 | Bhavsar | 68/27 |
| 4,156,358 | 5/1979 | Harrsch | 68/27 |
| 4,236,393 | 12/1980 | Katzfey | 68/27 |
| 4,494,265 | 1/1985 | Schmidt et al. | 8/159 |
| 4,984,438 | 1/1991 | Batty | 68/143 X |

FOREIGN PATENT DOCUMENTS 61-1903 1/1986 Japan .

*Primary Examiner*—Philip R. Coe

*Attorney, Agent, or Firm*—McAulay Fisher Nissen Goldberg & Kiel

[57] ABSTRACT

A washing method by a continuous washing machine including a drum having a charge port of a wash at one end and a discharge port thereof at the other end, partitions for dividing the drum into a plurality of chambers, and a scoop for scooping up the wash with the rotation of the drum and sequentially transferring it from a chamber on the side of charge port to a chamber on the side of discharge port, in which the normal rotation of the drum without transfer in the transfer direction and the reverse rotation without transfer are repeated several times to oscillate the wash several times, and then by the reverse rotation of the drum of one complete turn or more, the raising/dropping motion of the wash is performed by the scoop at least once, whereby washing is carried out by the combination of several oscillating motions and at least one raising/dropping motion.

10 Claims, 18 Drawing Sheets

Figure 3I:
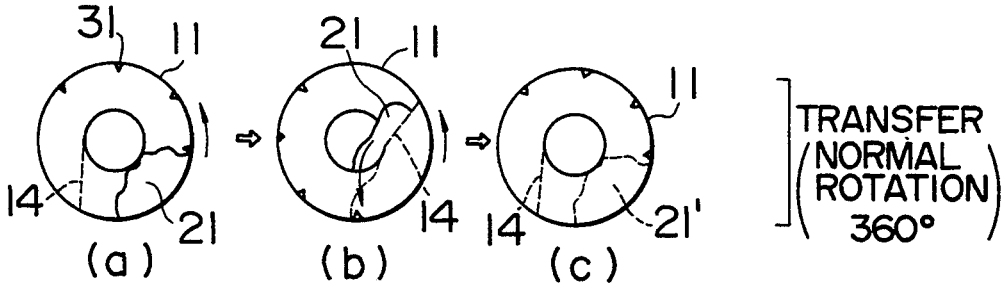
Figure 3:
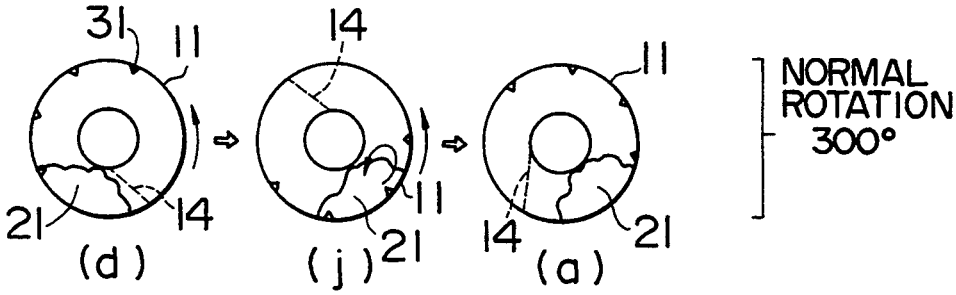

FIG. 3(III)
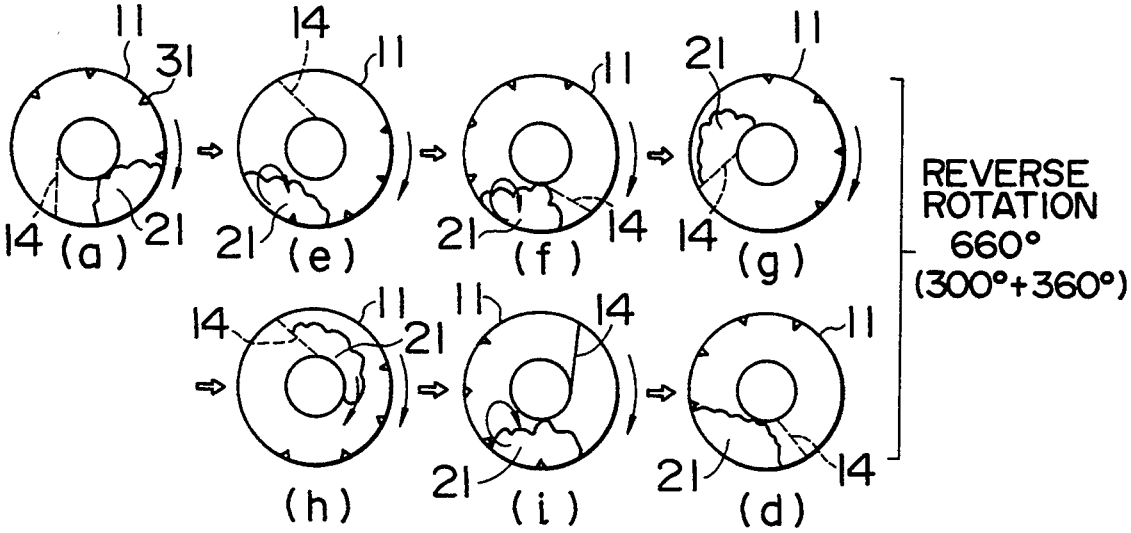

Figure 4I:
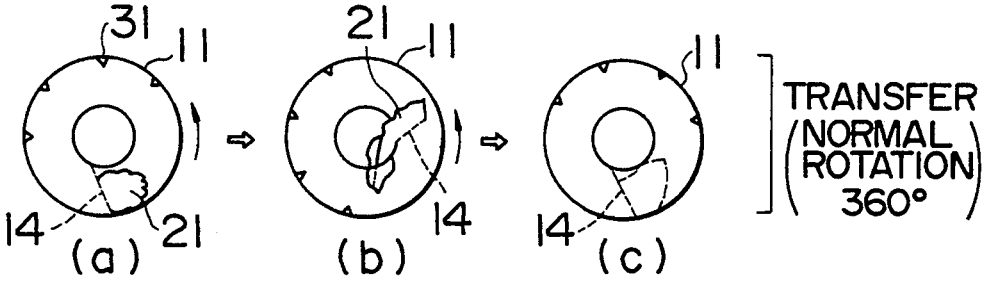
Figure 4:
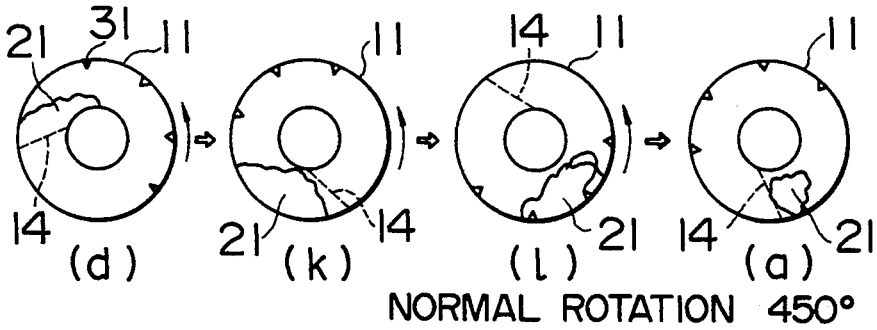

FIG. 4(III)
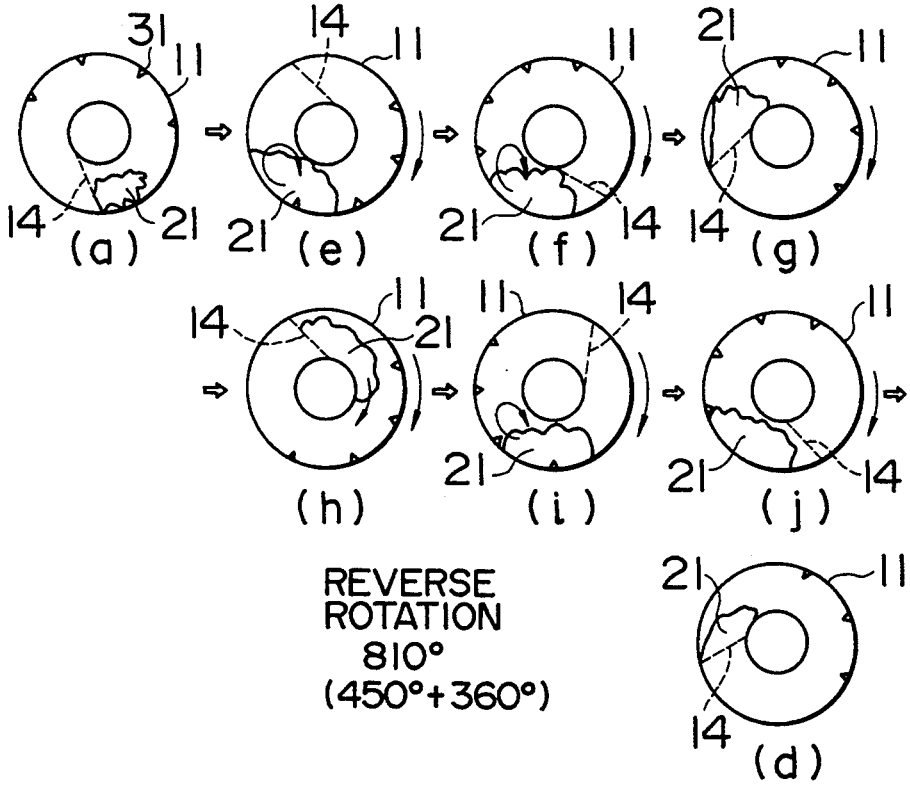

WASHING METHOD BY A CONTINUOUS WASHING MACHINE

This is a continuation of application Ser. No. 08/157,331, filed Nov. 23, 1993, now abandoned, which, in turn, is a continuation of application Ser. No. 07/869,425, filed Apr. 16, 1992, now abandoned.

1. TITLE OF THE INVENTION

Washing method by a continuous washing machine.

2. FIELD OF THE INVENTION AND RELATED ART STATEMENT

This invention relates to a washing method by means of a continuous washing machine which continuously handles objects being washed.

Figure 5:
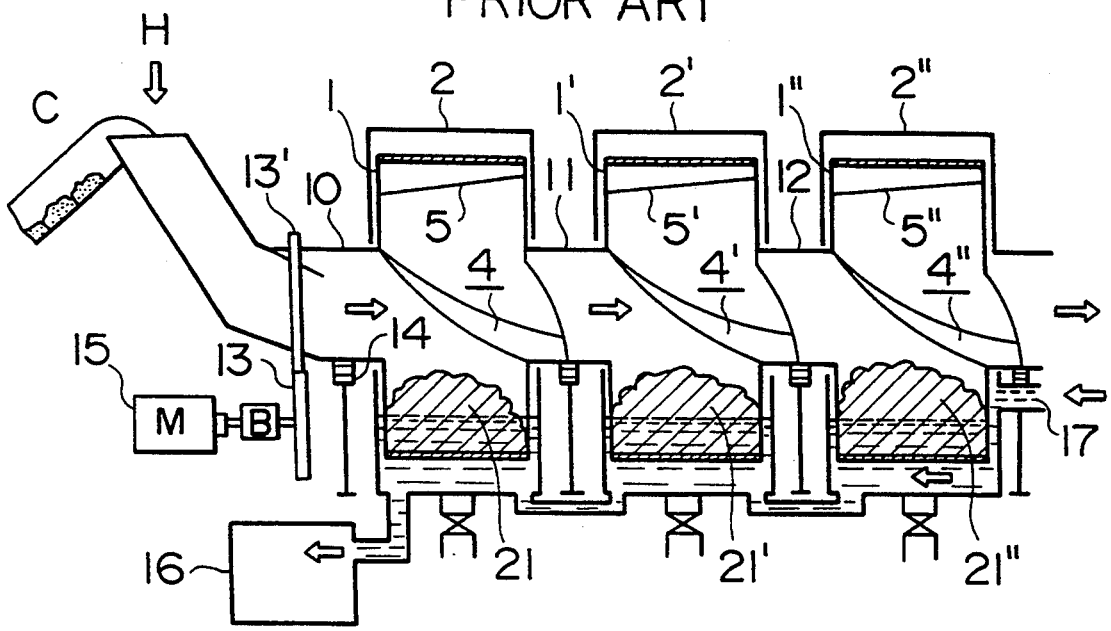
FIG. 5 PRIOR ART

FIG. 5 shows a continuous washing machine proposed in the Japanese Utility Model Publication No. 1903/1986. A wash, which is conveyed by supply conveyor C, is thrown into drum 1 in a stationary first vessel through chute or hopper H. An appropriate amount of a detergent and other additives may be thrown into the first vessel together with the wash or may be thrown into a second vessel or any of subsequent vessels. The detergent and additives may be thrown into a vessel separately or simultaneously by installing an inlet port or a valve.

Water enters through washing water inlet port 17 and, flows in the bottoms of stationary vessels 2'', 2', 2 as a continuous flow in the flow of direction opposite to the wash 21, 21', 21'', and enters contaminated water tank 16. The washing operation is performed by providing a plurality of serially connected drums 1, 1', 1''.

Figure 7A:
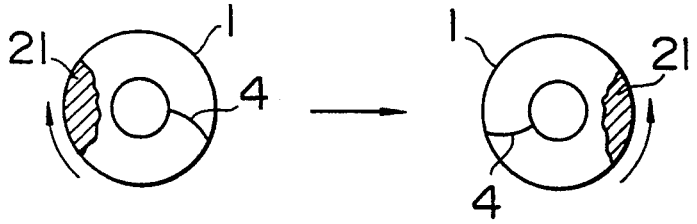
FIG. 7(a) PRIOR ART
Figure 7B:
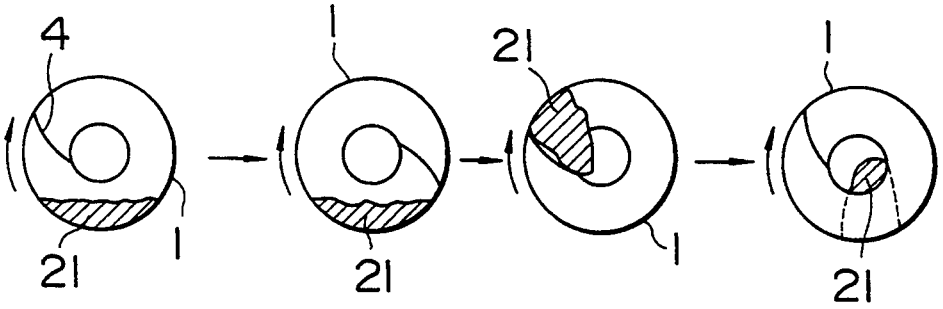
FIG. 7(b) PRIOR ART

Serially connected drums 1, 1', and 1'' are loaded with wash, an appropriate amount of a detergent and other additives. The drums are oscillated 180° or over, preferably about 270°, as shown in FIG. 7. In order to transfer the wash from the first drum 1 to the second drum 1', the drums are rotated in one direction at least 270° as shown in FIG. 7(*b*) and FIG. 8.

Figure 6:
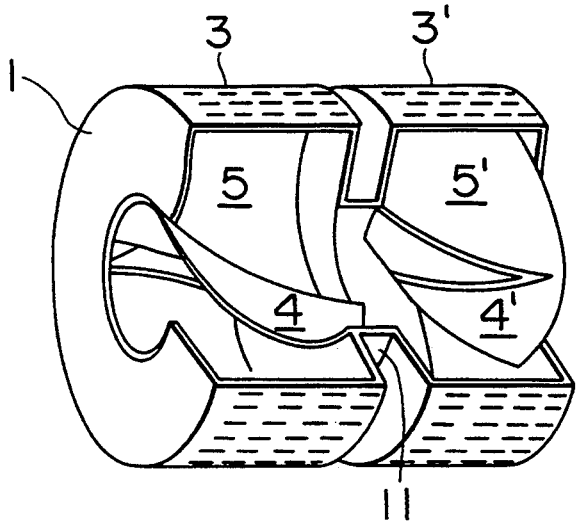
FIG. 6 PRIOR ART

The oscillation and full rotation for transfer are performed by means of gear 13 connected to motor with a reducer for driving drums (driving motor) 15 installed outside of the drum unit, gear 13' is installed at flange portion 10 of the drum 1, and a publicly known speed change clutch mechanism B. In the transfer operation of the wash from one vessel to the next vessel shown in FIG. 7(*b*) and FIG. 8, the wash is scooped up in each drum space, while the drum is rotated in one direction at least 270° by means of transfer scoop 4, 4', 4'' installed in the drum as shown in FIG. 6. The rotating scoop transfers the wash from drum 1 to drum 1', 1'' in sequence through flange portion 11, 12. At this time, washing water escapes from slits 3, 3' between scoop 4, 4', 4'' and auxiliary plate 5, 5', 5''. Reference numeral 14 denotes a roller for supporting drums 1, 1', 1''.

Figure 9:
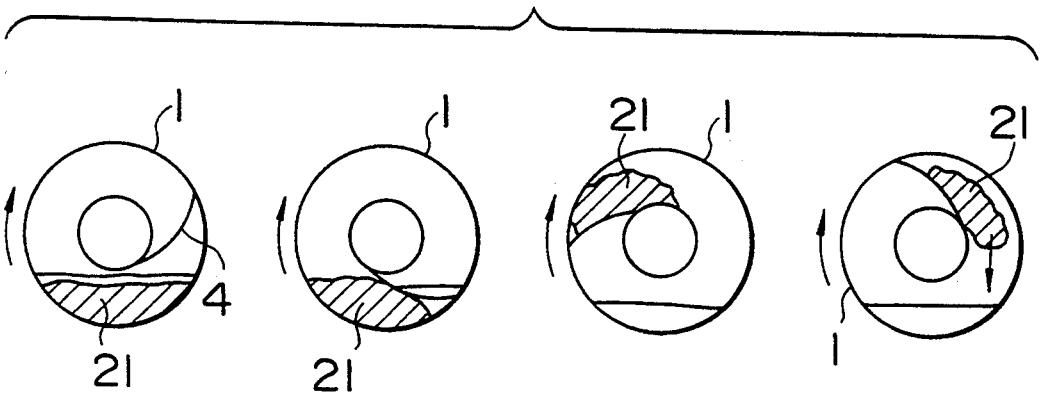

Washing may be performed by another method using the above constitution, in which the drum is rotated continuously in certain number of cycles in the direction opposite to the direction of rotation for transfer, instead of oscillation of 270° so that wash 21 is raised on the back of scoop 4 and dropped as shown in FIG. 9. With this method, wash 21 drops only once for one rotation of the drum.

The above-described crumple washing operation by the oscillation of drums 1, 1', 1'' has the disadvantage that the mechanical action given to the wash is weak.

As a result heavily soiled objects cannot be washed clean. With the washing method in which the wash is raised on the back of scoop and dropped repeatedly, the wash is twisted and tangled because the drum rotates in one direction. Therefore, a disentangling operation is needed afterward, which requires much manpower.

On the continuous washing machine described above, washing can be performed efficiently without stopping drum 1 by throwing a new wash into drum 1 at the same time when wash 21 is transferred to drum 1. However, there is a possibility that the amount of wash added into drum 1 is hindered due to the end face of scoop 4 blocking part of the charge opening depending upon the rotation angle of drum 1. Particularly when wash 21 is conveyed sequentially by a conveyor, all of the newly added wash cannot be thrown into drum 1 in one motion. Part of the newly added wash is thrown into drum 1 with part of the opening being blocked, so that the newly added wash is twisted or tangled by scoop 4. As a result, the newly added wash may be torn.

3. OBJECT AND SUMMARY OF THE INVENTION

This invention was proposed to solve the above problems with the conventional washing method.

The first method of this invention is a washing method by a continuous washing machine comprising a drum having a charge port and a discharge port for wash at each end, respectively, partitions for dividing the drum, a means for scooping the wash to transfer it to the next section, a supply means for supplying washing water and rinsing water into the drum, and a discharge means for discharging the washing water and rinsing water to the outside, whereby washing and rinsing are performed continuously while the wash is transferred sequentially from the charge port to the discharge port, in which the drum is rotated 450° or less without transfer in the transfer direction, the drum is rotated 450° or less plus 360° or more in the non-transfer direction, and these rotating motions are repeated alternately to perform both washing by oscillation and washing by raising and dropping the laundry.

With this method, in addition to the conventional oscillation of 270° of the drum, the rotation is performed one turn or more (360° or more) when the drum is rotated in the non-transfer direction, by which the wash on the back of the scoop is raised and dropped. Thus, the wash is alternately subjected to crumple washing by the oscillation of drum and beat washing by raising and dropping the laundry.

As described above, by adding beat washing by dropping the wash from a high position to the conventional crumple washing by oscillation, the mechanical force is increased, resulting in improved washing. Also, the oscillation and alternate rotation in the normal and reverse direction instead of the rotation in one direction prevents the wash from being tangled.

The second method of this invention is a washing method by a continuous washing machine comprising a drum having a charge port of a wash at one end and a discharge port thereof at the other end, partitions for dividing the drum into a plurality of chambers, and a scoop for scooping up the wash with the rotation of said drum and sequentially transferring it from a chamber on the side of the charge port to a chamber on the side of the discharge port, in which the normal rotation of the drum without transfer in the transfer direction and the reverse rotation without transfer are repeated several times to oscillate the wash several times, and then by the reverse rotation of the drum of one complete turn or more, the raising/dropping motion of the wash is performed by the scoop at least once, by which washing is carried out by the combination of several oscillating motions and at least one raising/dropping motion.

With this method, the mechanical force applied to the wash can be selected arbitrarily by setting the number of cycles of oscillation and the number of cycles of raising/dropping motions.

The third method of this invention is a washing method by a continuous washing machine comprising a drum having a charge port of a wash at one end and a discharge port thereof at the other end, partitions for dividing the drum into a plurality of chambers, and a scoop for scooping up the wash with the rotation of said drum and sequentially transferring it from a chamber on the side of the charge port to a chamber on the side of the discharge port, in which the drum is oscillated several times immediately after the drum is rotated for transfer of the wash.

In this method, a wash is thrown into the vessel at the same time when the drum is rotated for the transfer of a wash, and immediately after this operation, the drum is oscillated several times, so that the condition in which the opening area of the charge port is the maximum is repeated despite sequential transfer of the wash, which enables smooth supply of a wash into the drum.

The fourth method of this invention is a washing method by a continuous washing machine comprising a cylindrical drum having a charge port and a discharge port of a wash at each end, respectively, a rotating body having partitions in the drum for dividing the drum into a prewashing zone, a regular washing zone, and a rinsing zone, wherein a drain box with a drain water valve is positioned either at the boundary between the regular washing zone and the prewashing zone or at the boundary between the rinsing zone and the regular washing zone, and a washing water supply pipe for supplying washing water to the drain boxes, whereby washing is performed sequentially by transferring the wash toward the discharge port while repeating oscillating motions of the rotating body in the normal and reverse directions, in which after the wash is carried into the drain box, the normal and reverse rotation of the rotating body is performed at an oscillation angle smaller than the usual angle until washing water is drained by opening the drain water valve and, after the completion of draining, washing water is supplied via the washing water supply pipe by closing the drain water valve.

In this method, the rotating body is oscillated at an angle at which the wash is not raised high in the drum in the period of time from the start of drainage in the drain box to the completion of supply of a specified amount of washing water, so that the damage to the wash due to a shock caused by dropping from a high position is prevented.

The present invention will be described below with reference to the embodiments shown in the drawings.

4. BRIEF DESCRIPTION OF THE DRAWINGS

Figure 1:
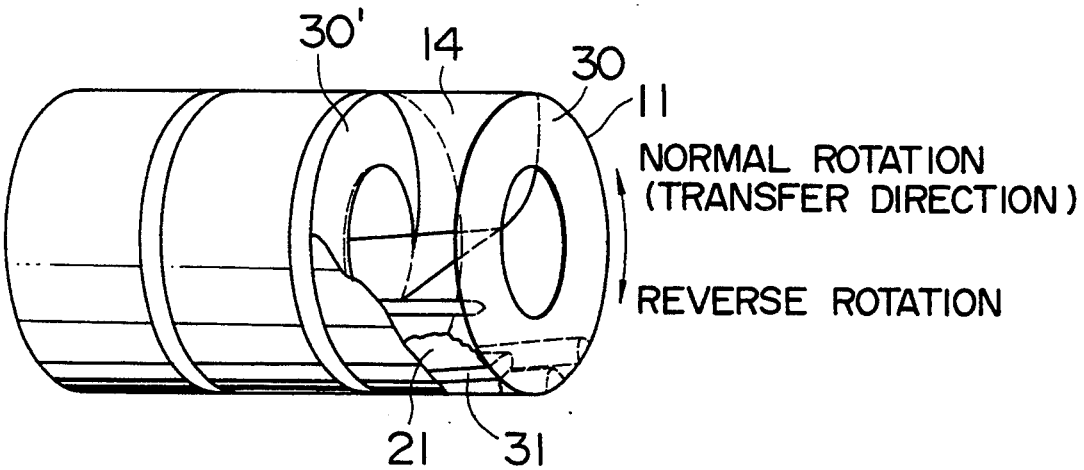
Figure 2:
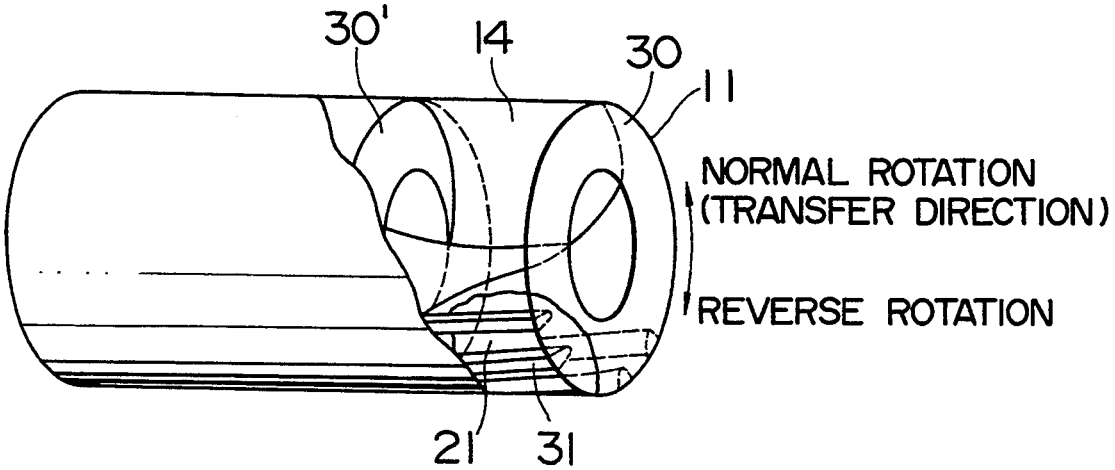
Figure 8:
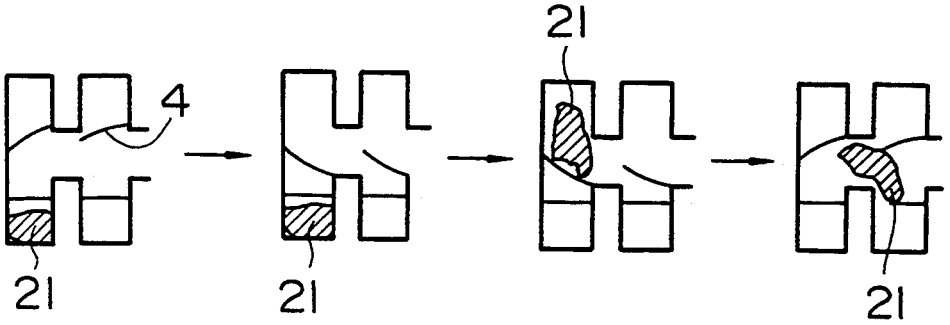
FIG. 8 PRIOR ART
Figure 10:
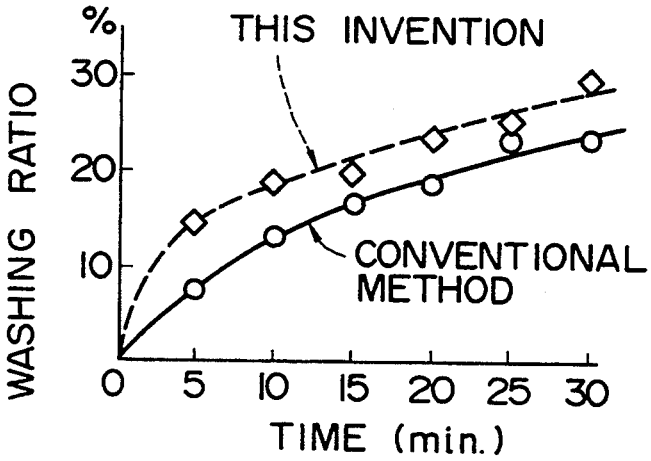
PRIOR ART FIG. 10
Figure 11:
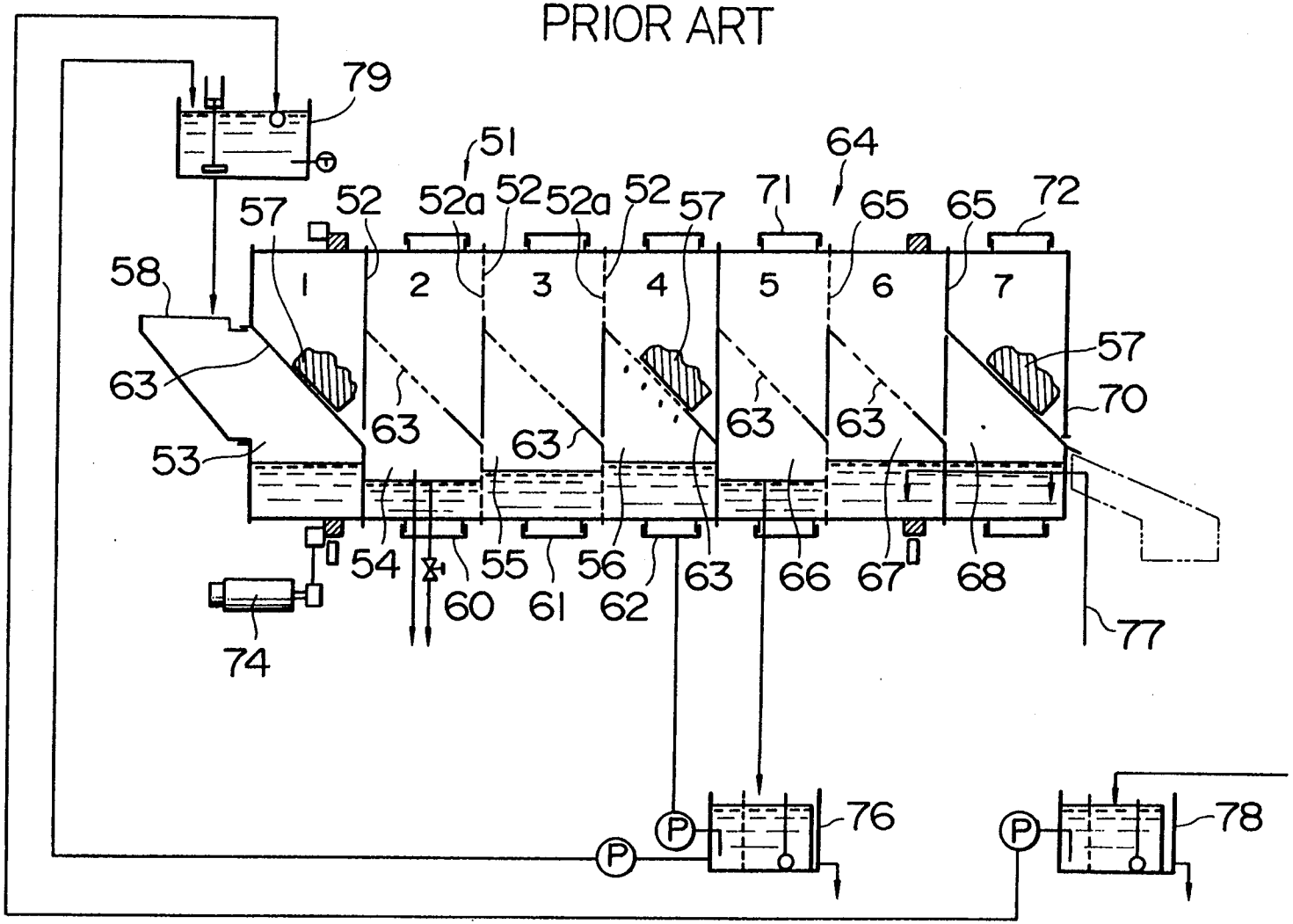
FIG. 11 PRIOR ART
Figure 12:
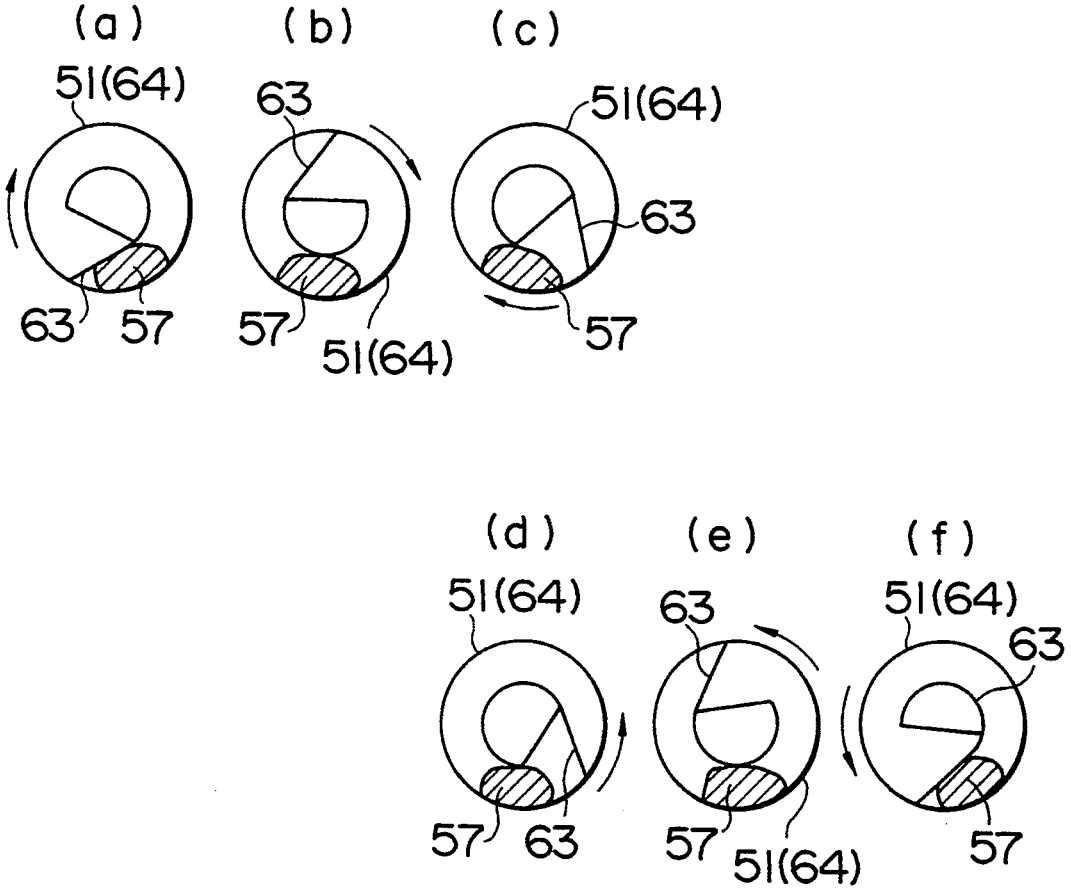
Figure 13:
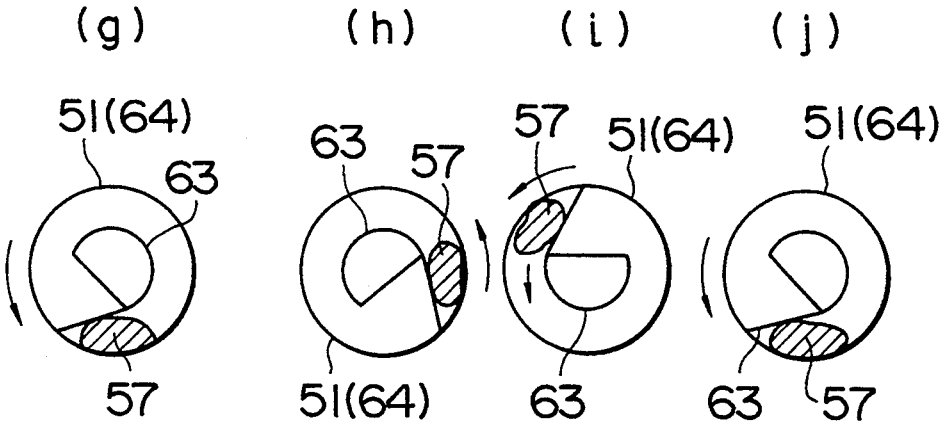
Figure 14:
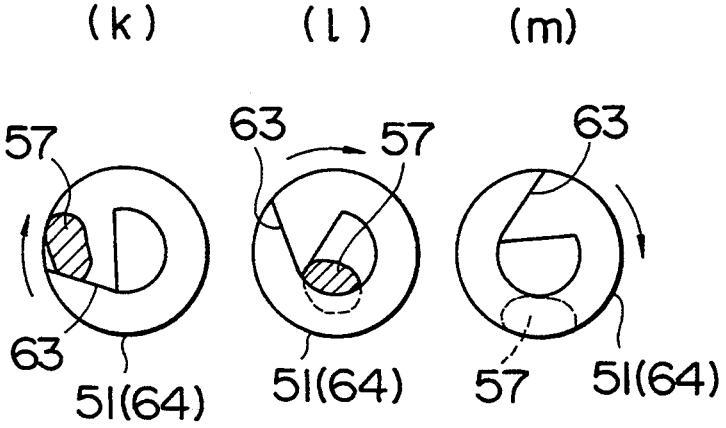
Figure 15:
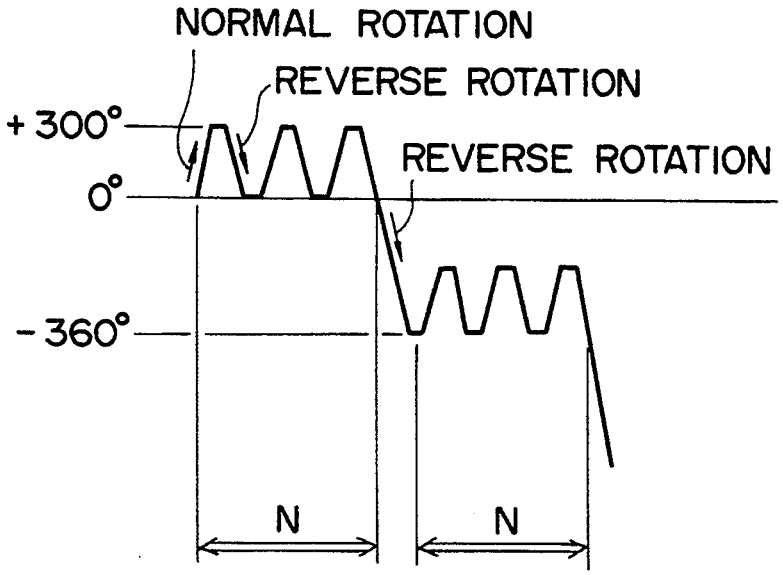
Figure 16:
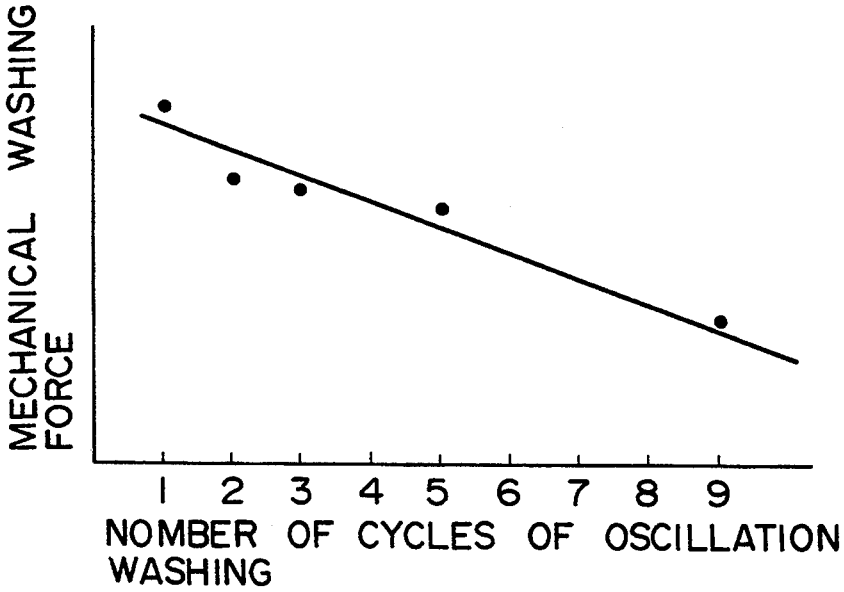
Figure 17:
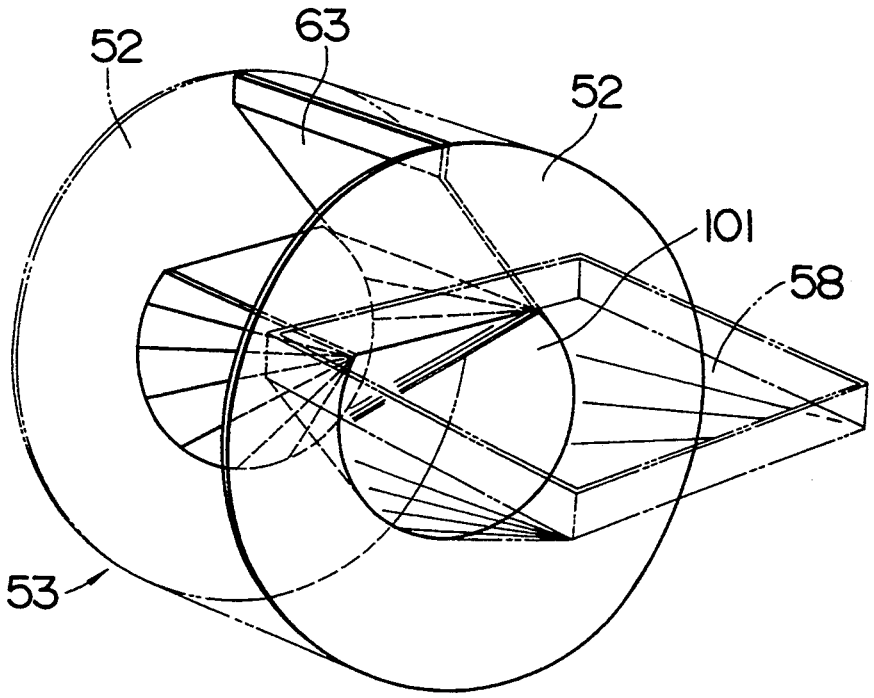
Figure 18:
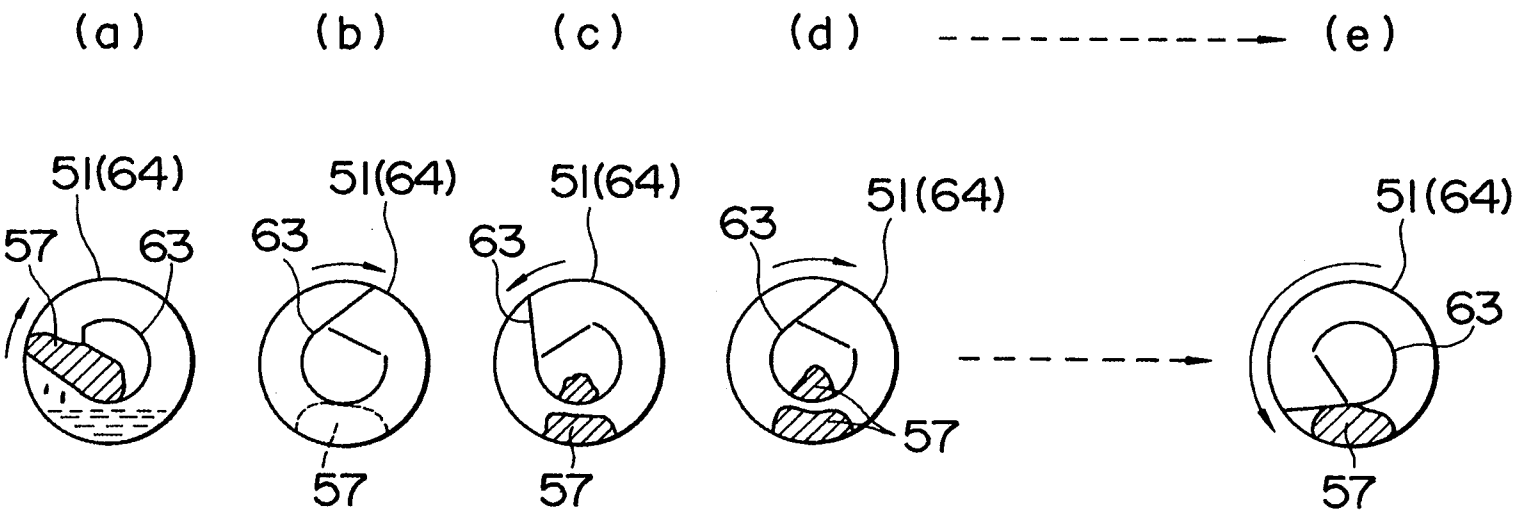
Figure 19:
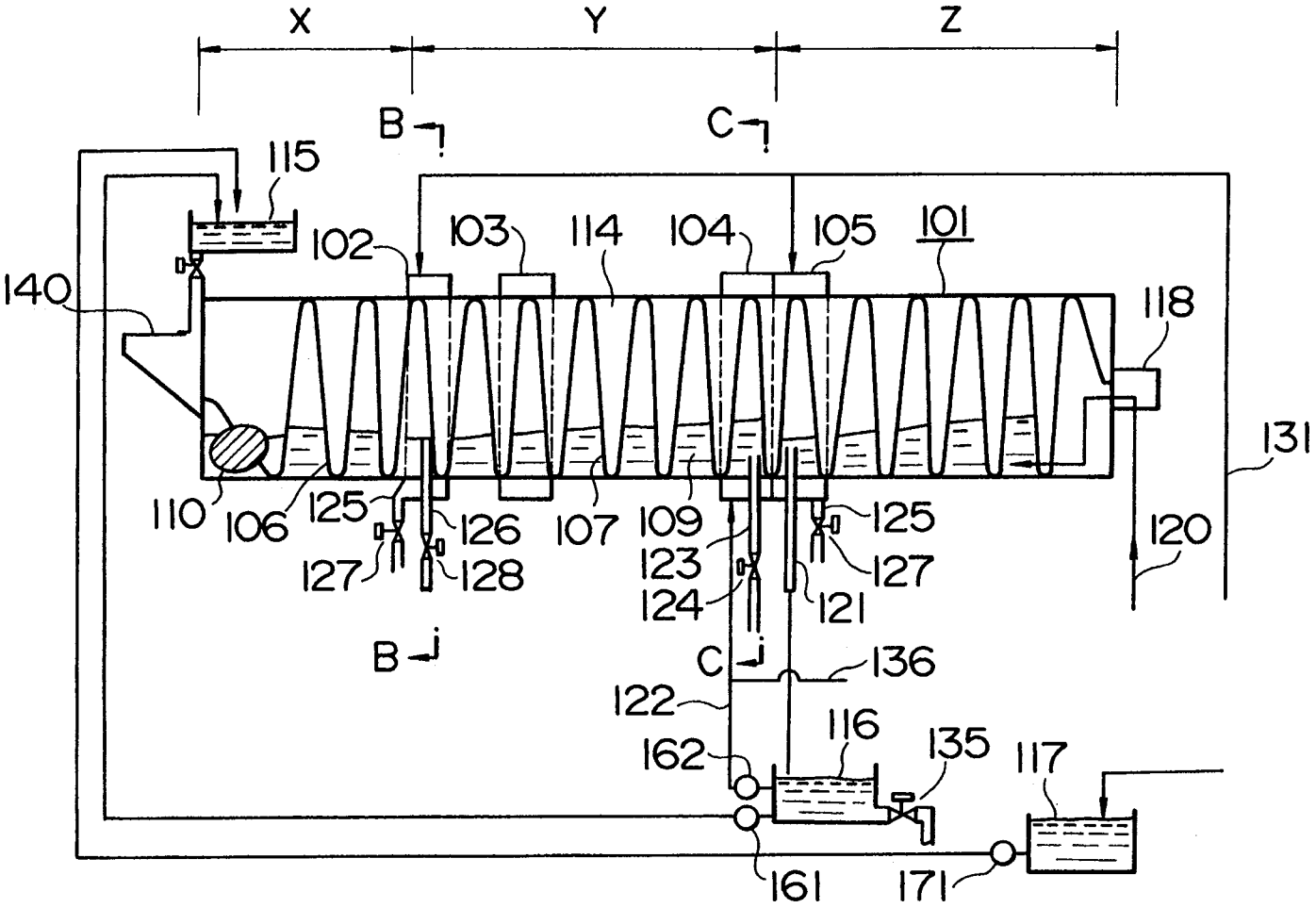
Figure 20:
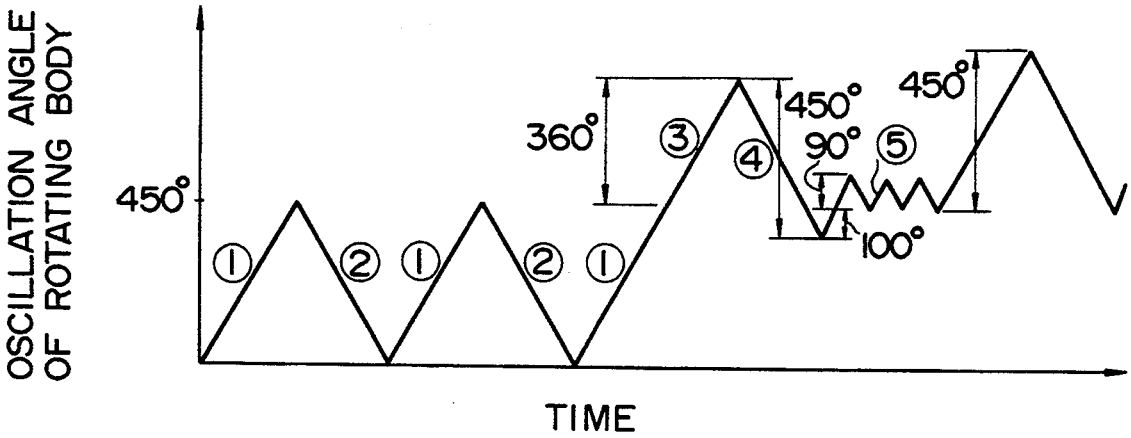
Figure 21:
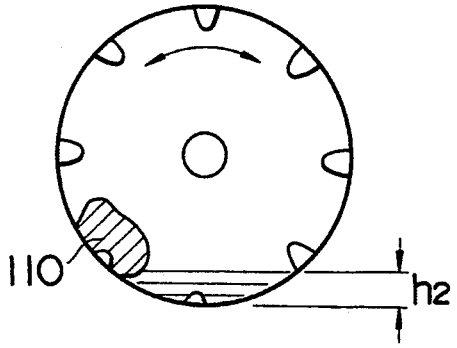
Figure 22:
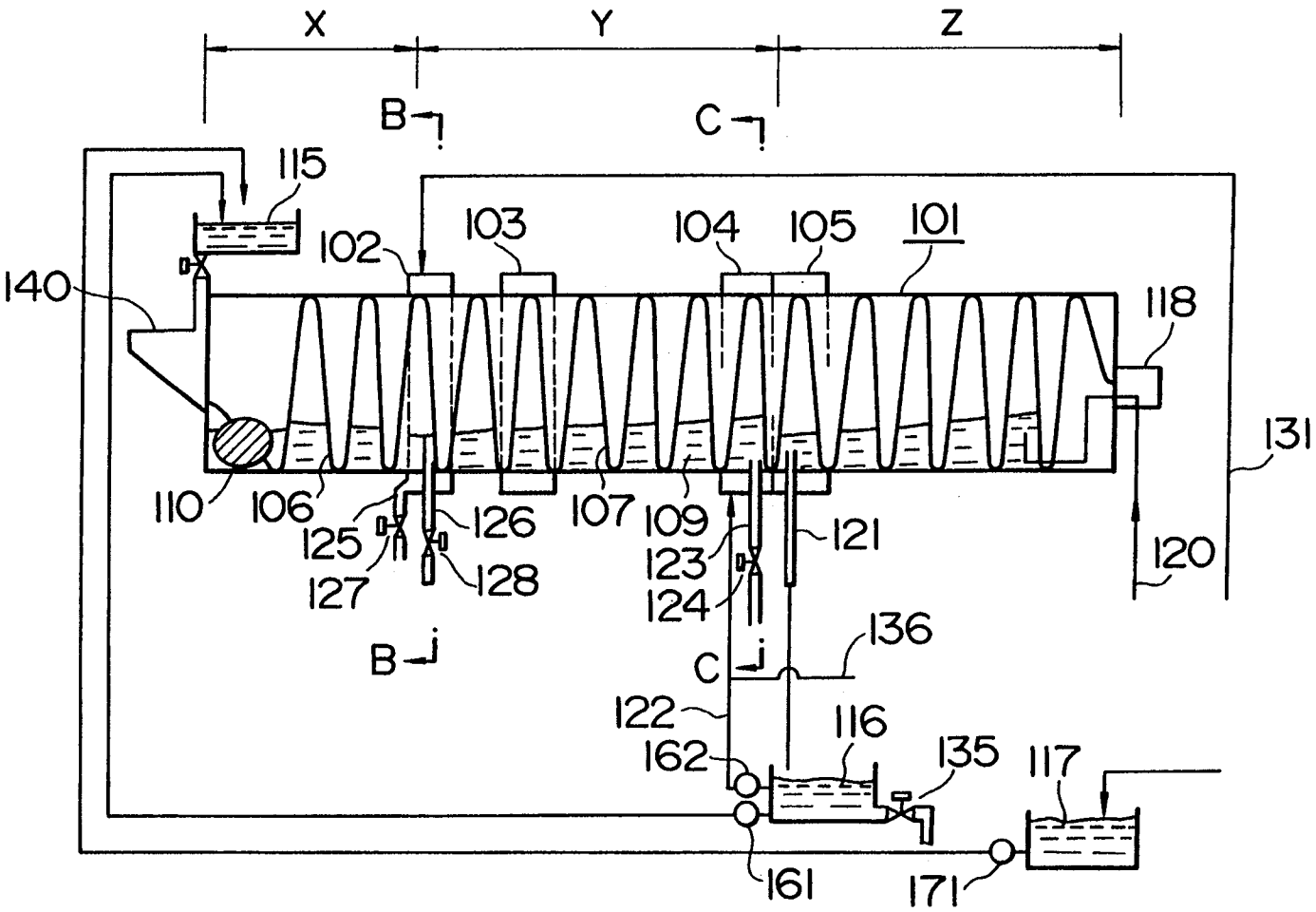
FIG. 22 PRIOR ART
Figure 23:
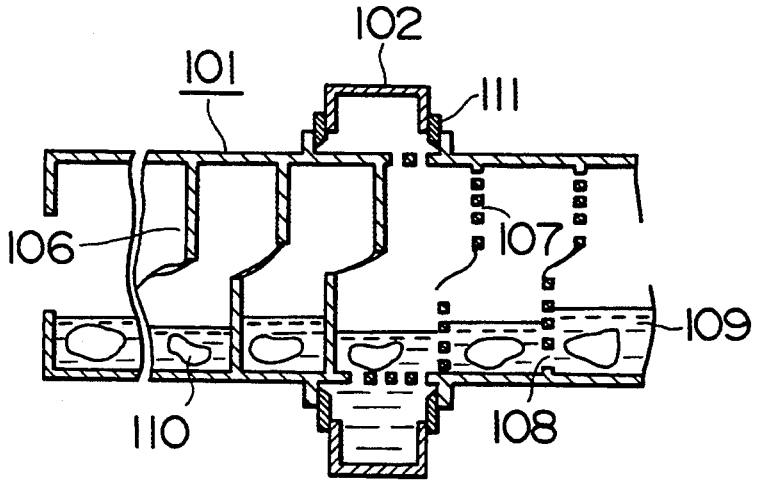
FIG. 23 PRIOR ART
Figure 24:
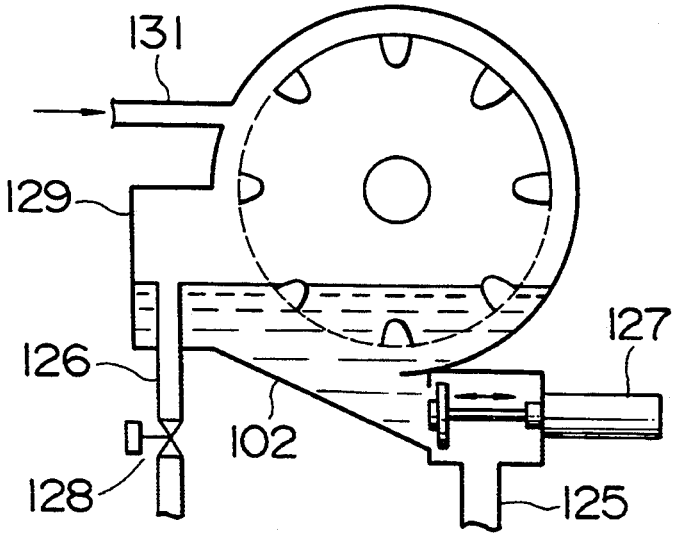
FIG. 24 PRIOR ART
Figure 25:
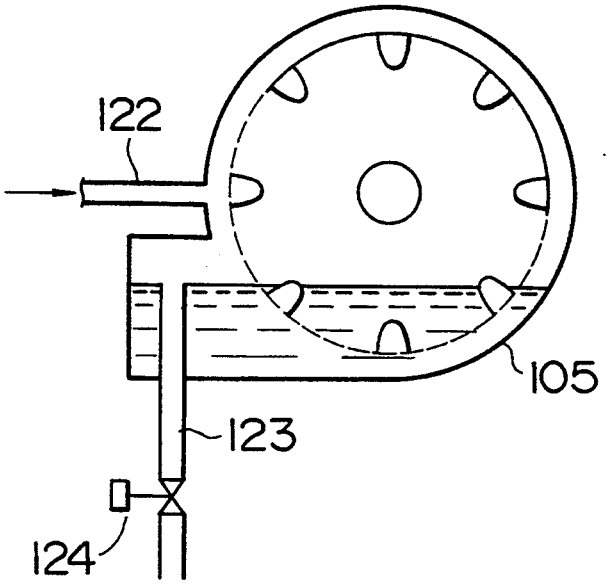
FIG. 25 PRIOR ART
Figure 26:
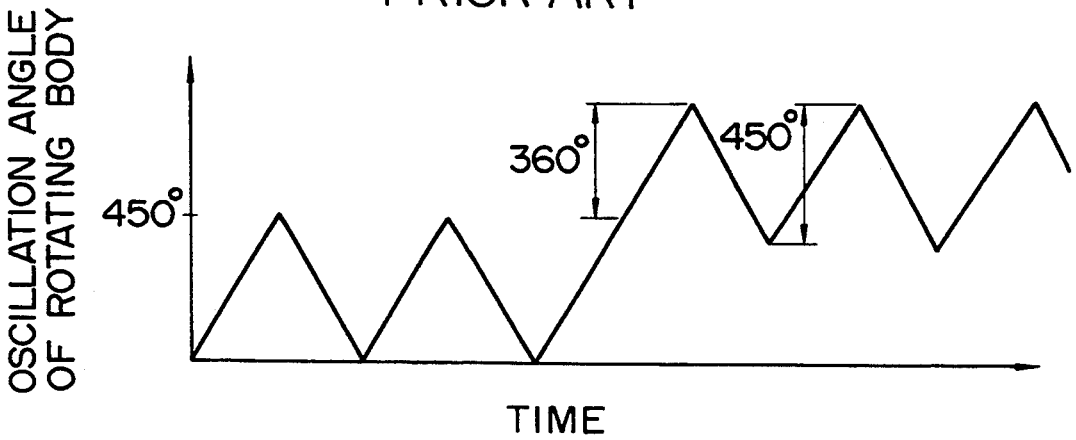
FIG. 26 PRIOR ART
Figure 27:
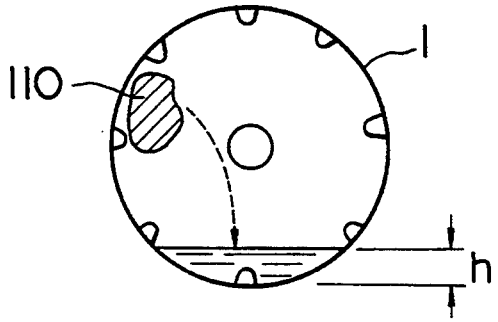
FIG. 27 PRIOR ART
Figure 28:
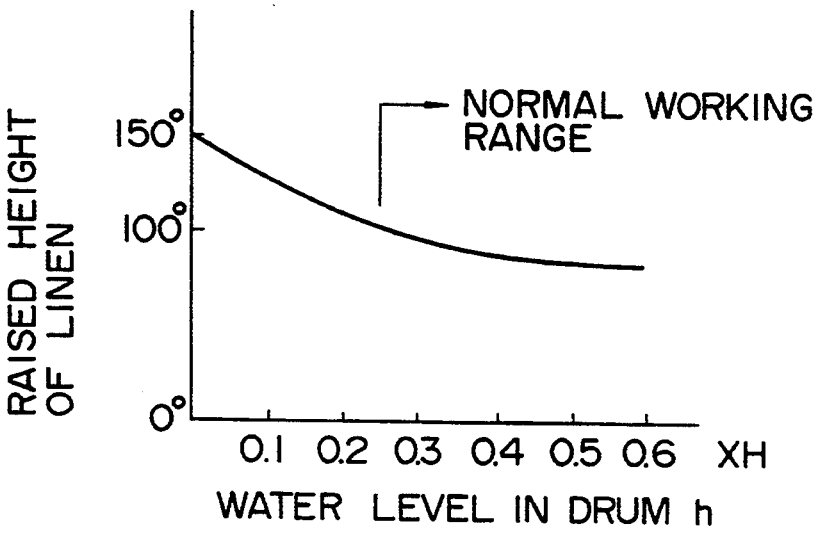
FIG. 28 PRIOR ART

In the drawings,

FIG. 1 is a partially cutaway perspective view of a drum for carrying out the first method of this invention, FIG. 2 is a partially cutaway perspective view of a drum which operates in a different manner from the drum in FIG. 1, FIG. 3(I) illustrates rotation through 360° to effect transfer of laundry according to the present invention, FIG. 3(II) illustrates the counter-clockwise rotation through 300° subjecting the laundry to crumble washing without transfer according to the present invention, FIG. 3(III) illustrates clockwise rotation through 660° subjecting the laundry to crumble and drop washing according to the present invention, FIG. 4(I) illustrates rotation through 360° to effect transfer of laundry according to the present invention, FIG. 4(II) illustrates the counter-clockwise rotation through 450° subjecting the laundry to crumble washing without transfer according to the present invention, FIG. 4(III) illustrates clockwise rotation through 810° subjecting the laundry to crumble and drop washing according to the present invention, FIG. 5 is a side sectional view of a conventional continuous washing machine, FIG. 6 is a partially cutaway perspective view of a drum in FIG. 5, FIG. 7(*a*) is a view for illustrating the phase change in the oscillation of the drum shown in FIG. 6, FIG. 7(*b*) is a view for illustrating the phase change in the transfer operation of the drum shown in FIG. 6, FIG. 8 is a side sectional view at each phase of drum in FIG. 7(*b*), FIG. 9 is a view for illustrating the phase change of conventional raising/dropping motion of linen, FIG. 10 is a diagram showing the relation between time and washing ratio for this invention and a conventional method, FIG. 11 is a schematic view of a continuous washing machine for carrying out the second method of this invention, FIG. 12 is a view for illustrating the motion of washing by oscillation, FIG. 13 is a view for illustrating the motion of washing by raising/dropping, FIG. 14 is a view for illustrating the motion of transfer, FIG. 15 is a diagram for illustrating the motion in an example of washing method, FIG. 16 is a graph showing the relation between washing mechanical force and the number of cycles of oscillation washing, FIG. 17 is a perspective view showing the inside construction of a first vessel of continuous washing machine using the third method of this invention, FIG. 18 is a view for illustrating the motion for transfer, FIG. 19 is a schematic view of a continuous washing machine using the fourth method of this invention, FIG. 20 is a diagram showing the oscillation angle of rotating body, FIG. 21 is a view showing the position of wash in a drum, FIG. 22 is a schematic view of a conventional continuous washing machine, FIG. 23 is a side sectional view of a conventional drain box, FIG. 24 is a sectional view taken on the plane of the line B—B, FIG. 25 is a sectional view taken on the plane of the line C—C, FIG. 26 is a diagram showing the oscillation angle of rotating body in the conventional method, FIG. 27 is a view showing the position of wash in a drum, and FIG. 28 is a graph showing the relation between water level in drum and raised height of linen.

5. DETAILED DESCRIPTION OF PREFERRED EMBODIMENTS

FIGS. 1–4 show a first embodiment of this invention. In FIGS. 1 and 2, reference numeral 11 denotes a drum, which is constructed by connecting drums which can be separated for each vessel (refer to FIG. 1) or constructed so that two or more vessels composes one drum and the vessels are divided by partitions 30, 30′ (refer to FIG. 2). Reference numeral 14 denotes a scoop, which is fixedly secured to drum 11 and partitions 30, 30′. Scoop 14, which can transfer wash 21 to the next vessel, is shaped so as to be able to scoop up wash 21 in the normal rotation but not to transfer it to the other vessel.

Reference numeral 31 denotes a beater, which is fixedly secured to drum 11 and partitions 30, 30′. In FIGS. 1 and 2, four beaters 31 are installed on the opposite side of scoop 14, but any number of beaters may be installed at any location. When drum 11 rotates, scoop 14 and beaters 31 rotate as a unit. At the bottom of drum 11, wash 21 lies together with washing water (not shown).

As shown in FIG. 3(I), when the drum 11 is rotated 360° from the condition shown in FIG. 3(I)(*a*) wash 21 is scooped up by a scoop 14 and transferred into the next vessel as shown in FIGS. 3(I)(*b*) and (*c*).

Therefore, on a continuous washing machine with scoop 14, oscillation in the normal and reverse directions is normally repeated for a certain period of time at a phase angle which does not allow wash 21 to be transferred, and then wash 21 is transferred into the next vessel by transfer operation. The phase angle which does not allow wash 21 to be transferred may be 450° at maximum, as shown in FIG. 4(II), when wash 21 is on the back of scoop 14, but it is usually set to 270°–300°.

The control of rotation and oscillation of drum 11 in normal rotation of 300° and in reverse rotation of 660° in this embodiment will be described with reference to FIGS. 3(II) and 3(III). As described above with reference to FIG. 3(I), after wash 21 is transferred by the normal rotation of 360° of drum 11, the condition of drum is as shown in FIG. 3(I) (*c*) or FIG. 3(II) (*a*).

As shown in FIG. 3(III), when drum 11 is rotated in the reverse direction in which wash 21 is not transferred, wash 21 is raised by beaters 31 and rotated to perform crumple washing in the same manner as the conventional oscillation in the range of positions illustrated by FIGS. 3(III)(*a*), (*e*) and (*f*). In the range of positions indicated by FIGS. (III) (*g*) and (*h*), wash 21 is scooped up to a high position in the drum on the back side of scoop 14 and is dropped to perform beat washing. In the range of positions illustrated by FIGS. 3(III) (*i*) and (*d*), crumple washing is performed by beaters 31. Thus, by the reverse rotation of 660° of drum 11 in the sequence of positions illustrated by FIGS. 3(III) (*a*)-(*e*)-(*f*)-(*g*)-(*h*)-(*i*)-(*d*), respectively wash 21 is crumple washed, raised once, and dropped for beat washing.

Next, drum 11 is rotated 300° in the normal direction in the sequence shown in FIGS. 3(II) (*d*), (*j*) and (*a*) respectively. In this process, the wash 21 is raised by beater 31 and rotated to perform crumple washing, and at the same time wash 21 is untwisted and untangled. Thus, the reverse rotation of 660° and normal rotation of 300° of drum 11 are repeated several times until the next transfer operation is performed to carry on washing.

Although the oscillation angle of drum 11 in the normal direction may be below 450° as shown in FIG. 4(II), the oscillation angle in the reverse direction should be the angle of normal rotation (300°) plus at least one complete rotation (360°).

FIGS.4(I),4(II), and 4(III) show an embodiment of normal rotation of 450° and reverse rotation of 810°. In the range of positions illustrated by FIGS. 4(I) (*a*), (*b*) and (*c*), wash 21 is scooped up by scoop 14 by the normal rotation of 360° of drum 11 from the condition of FIG. 4(I) (*a*), and is transferred into the next vessel by FIGS. 4(I) (*b*) and (*c*).

Immediately after the transfer drum 11 is rotated in the reverse direction in which wash 21 is not transferred. In the range of positions illustrated by FIGS. 4(III) (*a*), (*e*) and (*f*), the wash 21 is raised by beaters 31 and rotated to perform crumple washing. In the range of positions illustrated by FIGS. 4(III) (*g*), (*h*) and (*i*), wash 21 is scooped up to a high position in the drum on the back side of scoop 14 and is dropped to perform beat washing. In the range of positions illustrated by FIGS. 4(III) (*i*) and (*j*), crumple washing is performed by beaters 31. In the range of positions illustrated by FIGS. 4(III) (*j*) and (*d*), wash 21 is scooped by the back of scoop 14, but it does not drop. The drum stops at the position illustrated in FIG. 4(III) (*d*), and then is rotated in the normal direction according to the sequence illustrated in FIG. 4(II).

As shown in FIG. 4(II), drum 11 is then rotated 450° in the normal direction in the sequence illustrated by FIG. 4(II) (*d*)-(*k*)-(*l*)-(*a*), respectively. In this process, wash 21 is raised by beater 31 and rotated to perform crumple washing, and at the same time wash 21 is untwisted and untangled.

Then, the reverse rotation of 810° in FIG. 4(III) and normal rotation of 450° in FIG. 4(II) of drum 11 are repeated several times until the next transfer operation is performed to carry on washing.

According to this invention, as described above, raising/dropping of wash 21 by the scoop is combined with the oscillation to effectively perform both crumple washing and beat washing, which improves the washing property about 10% as compared with the conventional method 15 as shown in FIG. 5. Accordingly the washing time is shortened, resulting in higher productivity as compared with the conventional machine. When washing is performed by rotating in one direction, particularly a long wash such as sheets is twisted or tangled in the vessel, which requires much manpower for disentangling. This invention provides a method in which twisting and tangling do not occur and which has a high washing ratio.

A continuous washing machine which carries out the second method of this invention will be described with reference to FIGS. 11 through 14. FIG. 11 is a schematic view of the continuous washing machine, and FIGS. 12 through 14 show the operation of the drum.

The constitution of the continuous washing machine will be described with reference to FIG. 11.

In FIG. 11, reference numeral 51 denotes a washing drum. Washing drum 51 is divided into four vessels (chambers) 53, 54, 55, 56 by partitions 52. At first vessel 53, charge port 58 for wash 57 is disposed. First partition 52 between first vessel 53 and second vessel 54 is constructed so as to prevent water from flowing from the adjacent vessel. The partitions between second vessel 54 and third vessel 55 and between third vessel 55 and fourth vessel 56 have many holes formed to allow water to flow.

Prewashing is performed in first vessel 53 in washing drum 51, and regular washing is performed in second vessel 54, third vessel 55, and fourth vessel 56. Reference numerals 60, 61, 62 denote fixed drums for supplying/discharging water, supplying a detergent, and heating washing drum 51.

Reference numeral 64 denotes a rinsing drum. Drum 64 is divided into three chambers (vessels) 66, 67, 68 by partitions 65. At seventh vessel 68, discharge port 70 for wash 57 is disposed. Reference numerals 71, 72 denote fixed drums for supplying water to and discharging water from rinsing drum 64.

Washing drum 51 and rinsing drum 64 are formed as a unit and driven by geared motor 74.

Scoop 63 is installed in each vessel 53–56 and 66–68. Scoop 63 is so constructed that it scoops up wash 57 and sends it to the next vessel toward discharge port 70 when washing drum 51 and rinsing drum 64 rotate in the normal direction, and it scoops up wash 57 but does not send it to the other vessel when washing drum 51 and rinsing drum 64 rotate in the reverse direction.

In the figure, reference numeral 76 denotes a recycling tank, 77 denotes rinsing water, 78 denotes a water recovery tank, and 79 denotes a water supply tank.

The operation of a continuous washing machine constituted as described above will be described with reference to FIGS. 12 through 14. FIG. 12 shows the operation for oscillation washing, FIG. 13 shows the operation for washing by raising/dropping of the wash, and FIG. 14 shows the operation for transfer.

As shown in FIG. 12, when washing drum 51 and rinsing drum 64 are rotated in the normal direction range of positions shown in FIGS. 12(*a*), (*b*) and (*c*), respectively, and then in the reverse direction as illustrated in the range of positions shown in FIGS. 12(*d*), (*e*) and (*f*), respectively, crumple washing of wash 57 is performed by 25 beaters (not shown) installed on the inner surfaces of drums 51, 64 (oscillation washing). In this process, a low mechanical force is applied to wash 57 for washing.

As shown in FIG. 13, when washing drum 51 and rinsing drum 64 are rotated 360° in the reverse direction in the sequence illustrated by FIGS. 13(*g*), (*h*), (*i*), and (*j*), respectively, wash 57 is scooped up to a high position in washing drum 51 and rinsing drum 64 on the back side of scoop 63 and then is dropped to perform beat washing (washing by raising/dropping). In this process, a high mechanical force is applied to wash 57 for washing.

As shown in FIG. 14, when washing drum 51 and rinsing drum 64 are rotated in the normal direction through the range of positions illustrated by FIGS. 14(*k*), (*l*) and (*m*), wash 57 is scooped up by scoop 63 FIG. 14(*k*), slides down on the sloping surface of scoop 63 FIG. 14(*l*), and is transferred to the next vessel FIG. 14(*m*) (transfer).

On the above-described continuous washing machine, wash 57, which is thrown into the drum through charge port 58, is washed in sequence (washing, rinsing) and sent to a dehydrator (not shown) through discharge port 70 by repeating oscillation washing, washing by raising/dropping, and transfer.

FIG. 15 is a diagram showing an example of one cycle of the washing process of this invention.

First, the oscillation washing shown in FIG. 12 (the normal and reverse rotation of 300° of washing drum 51 and rinsing drum 64) is repeated three times. Then, the washing by raising/dropping shown in FIG. 13 (the reverse rotation of 360° of washing drum 51 and rinsing drum 64) is performed once. Then, the oscillation washing shown in FIG. 12 is repeated three times. In one vessel, three cycles of oscillation washing and one cycle of washing by raising/dropping are repeated for a certain washing time.

The number of cycles of oscillation washing N is selected appropriately in accordance with the soiled condition, type, etc. of wash 57.

For example, when wash 57 is heavily soiled, the number of cycles of oscillation washing N is decreased, and the number of cycles of washing by raising/dropping for a certain washing time is increased to remove the soil of wash 57 by means of a high mechanical force.

When wash 57 is made of a weak material, the number of cycles of oscillation washing N is increased, and the number of cycles of washing by raising/dropping for a certain washing time is decreased so that the soil of wash 57 is removed by means of a low mechanical force to reduce the damage to wash 57.

By appropriately determining, as the parameters of washing, the rotating angle of washing drum 51 and rinsing drum 64, their rotational speed, and the number of cycles of oscillation washing N, the washing pattern, that is, how many cycles of oscillation washing are performed and then how many cycles of raising/dropping washing are performed in one vessel for a certain washing time, can be set arbitrarily. The washing pattern can be easily changed by changing the parameters.

As the number of cycles of oscillation washing N increases, the number of cycles of raising/dropping washing for a certain washing time decreases. Therefore, the mechanical washing force applied to wash 57 decreases with the increase in the number of cycles of oscillation washing N as shown in FIG. 16.

Thus, by using the above-described washing method, the mechanical washing force can be selected arbitrarily in accordance with the soiled condition and the material of wash 57; for example, a heavily soiled wash can be washed by a strong mechanical force, while a wash which may be easily damaged can be washed in such a manner as to prevent the damage.

In the above-described washing method, the oscillation washing is performed several times, and then the raising/dropping washing is performed at least once, so that the mechanical washing force can be selected arbitrarily. As a result, washing can be carried out by the optimum mechanical washing force in accordance with the soiled condition and the material of wash 57.

A continuous washing machine which carries out the third method of this invention is the same as that shown in FIG. 11, except that first vessel 53 has opening 101 connecting to charge port 58 (charge chute) and part of opening 101 is blocked by the end face of scoop 63. The rotation of the drum rotates opening 101, so that the opening area of charge port 58 changes. As shown in FIG. 17, the opening area of charge port 58 becomes the maximum where the inclined surface of scoop 63 is approximately at the largest inclined angle.

The washing operation of a continuous washing machine constituted as described above will be described with reference to FIG. 12.

As shown in FIG. 12, when washing drum 51 and rinsing drum 64 are rotated in the normal direction through the range of positions illustrated by FIGS. 12(*a*), (*b*) and (*c*), respectively, and then in the reverse direction through the range of positions illustrated by FIGS. 12(*d*), (*e*) and (*f*), respectively, crumple washing of wash 57 is performed by beaters (not shown) installed on the inner surfaces of drums 51, 64 (oscillation washing).

FIG. 18 shows the operation of the drum in transfer.

As shown in FIG. 18, when washing drum 51 and rinsing drum 64 are rotated in the normal direction through the positions illustrated in FIGS. 18(*a*) and (*b*), wash 57 is scooped up by scoop 63, slides down on the sloping surface of scoop 63, and is transferred to the next vessel (transfer). From the rotational angle illustrated in FIG. 18(*a*), first vessel 53 is loaded with new wash 57. Since the opening area of opening 101 and charge port 58 of first vessel 53 reaches a maximum between the positions illustrated by FIGS. 18(*a*) and (*b*), washing drum 51 and rinsing drum 64 oscillate in a small range (for example, 60°–90°) two or three times in the range of positions illustrated in FIGS. 18(*c*) and (*d*). During this time, a prewashing fluid from a water supply tank (not shown) flows over charge port 58 (charge chute). After the small oscillation, the drums rotates in the reverse direction until the condition illustrated by FIG. 18(*e*) is reached to become ready for next washing.

By the small oscillation of washing drum 51 and rinsing drum 64 performed two or three times after the start of charging of wash 57, the condition in which the opening area of opening 101 and charge port 58 of first vessel 53 is the maximum is repeated. Therefore, a wash can surely be thrown into first vessel 53 even when a wash is sent sequentially irrespective of its bulk shape, type, size, etc. Also, there is no need for stopping the rotation of washing drum 51 and rinsing drum 64 when a wash is thrown into the vessel, which prevents the decrease in the efficiency of washing.

It is also possible to automatically continue the small oscillation until a new wash is added by installing a sensor for detecting the absence of a wash using a photoelectric tube or the like at the inlet of the charge chute to first vessel 53. When the small oscillation is continued for a long period of time, an alarm tells the operator that a wash is not thrown in.

On the above-described continuous washing machine, wash 57 thrown through charge port 58 is washed sequentially (washing, rinsing) by repeating the oscillation washing and the transfer including the charge of wash 57, and sent to a dehydrator (not shown) through discharge port 70.

By using the above-described transfer method, the condition in which the opening area of opening 101 and charge port 58 of first vessel 53 becomes the maximum is repeated when a wash is thrown into the vessel, so that the wash can be surely thrown into the vessel irrespective of its bulk shape, type, size, etc.

With this method, the condition in which the opening area of opening 101 and charge port 58 of first vessel 53 becomes the maximum is repeated when a wash is thrown into the vessel, since the drums are oscillated several times immediately after the rotation of the drum causing the transfer of wash. As a result, a wash sent sequentially can be surely thrown into the first vessel irrespective of its bulk shape, type, size, etc., and the wash is not twisted, tangled or torn by the scoop.

A continuous washing machine used in the fourth method is shown in FIG. 19. On this washing machine, drain discharge pipe 125 and air cylinder 127 are disposed at drain box 105 in addition to drain box 102, whereas on the publicly known washing machine as shown in FIG. 22, they are disposed at drain box 102 only.

The conventional continuous washing machine will be described with reference to FIGS. 22 through 26. Reference numeral 101 denotes a drum. Drum 101 is a cylindrical rotating vessel for washing wash 110. At each end of drum 101, an inlet port 140 for supplying wash 110 and an outlet port 18 for discharging wash 110, are positioned.

On the outside of drum 101, drain box 105 at the boundary between a rinsing zone and a regular washing zone, drain box 102 at the boundary between the regular washing zone and a prewashing zone, and heating boxes 103, 104 are fixed to a frame (not shown). Reference numerals 106, 107 are partitions. Partition 106 is welded to the inside of drum 101 in a spiral form. Prewashing zone X, the boundary vessel between prewashing zone X and regular washing zone Y, and the boundary vessel between regular washing zone Y and rinsing zone Z are formed by partition 106 constructed so that water is prevented from flowing to the adjacent vessel. Partition 107 disposed in other vessels has many holes 108 which allow washing water to pass through as shown in FIG. 23. Washing fluid 109 in drum 101 flows in the direction opposite to or same as the direction of wash 110 through holes 108.

In FIG. 23, reference numeral 111 denotes a lip seal, which is installed to provide sealing between rotating drum 101 drain box 102, 105, and heating box 103, 104. Normally, lip seal 111 is fixed to the fixed side of drain box 102, 105 and heating box 103, 104 with bolts. Lip seal 111 is made of India rubber, whose elastic force prevents the leakage of washing fluid 109.

In FIG. 22, reference numeral 115 denotes an immersion water tank. At the same time when wash 110 is supplied into drum 101, immersion water is supplied from immersion water tank 115 and wets wash 110 in a short period of time to facilitate the removal of soil.

Reference numeral 116 denotes a recycling tank. Rinse water 120 is supplied into the drum through rotary joint 118. The rinse water, after rinsing wash 110, overflows from water level regulating pipe 121, which is attached to drain box 105 and whose height is adjustable, to keep the water level in rotating drum 101 constant. The rinse water is stored in recycling tank 116.

Reference numeral 117 denotes a water recovery tank. This tank stores washing fluid 109 discharged from rotating drum 101 together with wash 110 which has been washed. From this tank, a certain amount of washing fluid is supplied to immersion water tank 115 via pump 171. At the same time, a certain amount of washing fluid 109 is supplied from recycling tank 116 by means of pump 161.

Reference numeral 122 is a regular washing water supply pipe. Normally, a certain amount of washing fluid 109 is supplied from recycling tank 116 to heating box 104 through supply pipe 122 by means of pump 162. At this time, valve 124 is closed. Valve 124 is installed to water level regulating pipe 123, whose height is adjustable and which is attached to heating box 104 (refer to FIG. 22).

Washing fluid 109 supplied through supply pipe 122 flows in the direction opposite to wash 110 and is drained to the outside of drum 101 through water level regulating pipe 126, whose height is adjustable and which is attached to drain box 102. Normally, valve 128 is open, so that washing fluid 109 supplied to heating box 104 is drained.

Reference numeral 125 denotes a drain water discharge pipe, which is fixed to drain box 102 and discharges the soil deposited at the bottom of drain box 102 by the operation of air cylinder 127. Air cylinder 127 is constructed so as to close the passage after it is operated for a certain time by a timer (not shown) (refer to FIG. 24).

Reference numeral 131 denotes a washing fluid supply pipe, which supplies a washing fluid according to the information from drain box 102. The washing fluid is supplied in a certain amount normally from recovery tank 117 or from warm water tank by means of a pump (not shown).

Reference numeral 135 denotes a recycling tank drain water valve, which is used to drain the water in the recycling tank after a wash whose color easily comes off has been treated. Reference numeral 136 denotes a fresh water supply pipe for regular washing, which is a water source used when the water in recycling tank 116 cannot be used. Reference numeral 140 denotes a charge port of a wash.

The operation of the machine constituted as described above is performed as follows: After a wash is thrown into the drum through the charge port, rotating body 114 oscillates about 450° in the normal and reverse directions for a certain period of time, and then rotates 360° to transfer the wash to the next rotating vessel. After the rotation, washing is performed by transferring the wash from prewashing zone X to regular washing zone Y to rinsing zone Z while being oscillated about 450° in the normal and reverse directions as described above (refer to FIG. 26).

In drain box 102, the drain water in the box is discharged, and washing water is supplied again to enhance the washing property and the rinsing property.

As described above, when the water in the drain box is discharged, the water level lowers. As a result, the wash is raised high when the water level is low as shown in FIG. 28 which shows the relation between water level and raised height of the wash. As shown in FIG. 27, wash 110 is raised up to a higher position in the drum than the case with the normal water level, and then drops in the drum with low water level h. Therefore, the wash is subjected to a strong shock, resulting in ease of damage. The present invention provides a washing method by a continuous washing machine which solves the above problem.

On a washing machine shown in FIG. 19, drain discharge pipe 125 and air cylinder 127 are disposed at drain box 105 in addition to drain box 102, whereas on the publicly known washing machine as shown in FIG. 22, they are disposed at drain box 102 only.

In FIG. 19, the sectional view of the drain box and the sectional views taken along the plane of line B—B and line C—C are the same as FIGS. 23, 24, and 25.

Next, the operation of the above-described constitution will be described.

The rotating body transfers a wash from the inlet port to the outlet port while repeating the oscillation in the normal and reverse directions at an angle shown in FIG. 20. In FIG. 20, the rotating body rotates 450° in the normal direction [(1) in the figure], and then rotates by the same angle in the reverse direction [(2) in the figure]. This motion is repeated. Next, the rotating body rotates 450° in the normal direction and further rotates 360° [(3) in the figure] to transfer the wash to the next rotating vessel. Then, air cylinder 127 is operated to discharge the washing water in drain box 102, 105 via drain water discharge pipe 125. The rotating body rotates 450° in the reverse direction as indicated (4) in the figure and further rotates 100° in the normal direction. This normal rotation of 100° is performed to adjust the position of holes 108 made in rotating body 114 and partition 107 to let washing water to flow. Until the drain water in drain boxes 102, 105 is discharged and a specified amount of washing water is supplied via washing water supply pipe 131, the rotating body is oscillated by an angle determined from the relation with the water level shown in FIG. 21, 90° in this embodiment, [(5) in the figure] in the normal and reverse directions. By this oscillation angle, the wash drops at a smaller angle than usual as shown in FIG. 21. Needless to say, the oscillation angle differs depending on the type, charge amount, etc. of the wash. Even if washing is performed with a small oscillation angle for a specified time, proper selection of the temperature of washing fluid, the concentration of detergent, etc. does not reduce the washing effect and prevents the wash from being damaged.

Although a connect-type washing machine having a spiral-shaped partition has been described in this embodiment, the present invention can be applied to a machine in which vessels are divided individually, and the wash is transferred with a scoop.

With the washing method of this invention, the oscillation angle is smaller than the usual angle until the drain water in the drain box is discharged and fresh washing water is supplied. This decreases the distance through which a wash drops in the drum, preventing the wash from being damaged.

What is claimed is:

1. A washing method for use with a continuous washing machine, the washing machine having a drum with an input end and a discharge end, partitions for dividing the drum into a plurality of chambers, and means for transferring the laundry from each of said plurality of chambers to an adjacent chamber nearer to said discharge end upon rotating said drum in a transfer direction, the method comprising the steps of:

loading laundry into a first chamber at said input end;

crumple washing the laundry by rotating said drum about an axis of rotation through a first angle in said transfer direction without transferring the laundry;

raise and drop washing the laundry by rotating said drum through a second angle in a direction opposite to said transfer direction without transferring the laundry so that the laundry is lifted above the axis of rotation by said means for transferring the laundry and then dropped to a portion of the drum below the axis after the laundry has passed above the axis of rotation of the drum; and, transferring the laundry from said first chamber to a second chamber by further rotating said drum through a third angle in said transfer direction.

2. The washing method of claim 1 wherein said first angle is 300°, said second angle is 660°, and said third angle is 360°.

3. The washing method of claim 1 wherein said first angle is 450°, said second angle is 810°, and said third angle is 360°.

4. The washing method of claim 1 further comprising the step of:

repeating said crumple washing and raise and drop washing steps before performing said transferring step.

5. The washing method of claim 1 wherein said crumple washing step comprises the steps of:

rotating said drum in said transfer direction through a fourth angle;

reversing said drum rotation through a fifth angle; and, repeating said rotating and reversing steps.

6. The washing method of claim 5 wherein said fourth angle is 300° and said fifth angle is 300°.

7. The washing method of claim 6 wherein said raise and drop washing is performed by rotating said drum in a direction opposite to said transfer direction through an angle of 360°.

8. The washing method of claim 5 further comprising the step of oscillating said drum through an angle in the range between 60° and 90° immediately after said transferring step to ensure proper transfer of the laundry.

9. The washing method of claim 1 further comprising the steps of:

adjusting said drum to discharge washing water after said transferring step;

supplying new washing water to said drum; and, oscillating said drum through a reduced angle during said adjusting and supplying steps to prevent damage to the laundry.

10. The washing method of claim 9 wherein said reduced angle is 90°.

* * * * *